United States Patent [19]

Hancock

[11] 4,070,833

[45] Jan. 31, 1978

[54] BRACING APPARATUS

[76] Inventor: Loren Hancock, P.O. Box 887, Cheyenne, Wyo. 82001

[21] Appl. No.: 678,049

[22] Filed: Apr. 19, 1976

[51] Int. Cl.[2] ..... E04H 12/20

[52] U.S. Cl. ..... 52/148; 52/149; 52/152

[58] Field of Search ..... 52/146–152

[56] References Cited

U.S. PATENT DOCUMENTS

| | | | |
|---|---|---|---|
| 1,035,102 | 8/1912 | Pritchard | 52/151 |
| 3,405,896 | 10/1968 | Eby | 52/148 |
| 3,817,006 | 6/1974 | Williams | 52/149 |

FOREIGN PATENT DOCUMENTS

| | | | |
|---|---|---|---|
| 529,964 | 6/1955 | Italy | 52/149 |

*Primary Examiner*—J. Karl Bell

*Attorney, Agent, or Firm*—Shanley, O'Neil and Baker

[57] ABSTRACT

Bracing apparatus for supporting vertically disposed structures, in particular wall constructions, prior to their connection with other components of a construction system. The apparatus includes an anchoring member, secured to a lower portion of the wall to be supported, through which a stay member, e.g., cable, is guided and each end of the cable is connected to distal end portions of a diagonal member. The anchoring member is first secured to the wall and the cable is threaded through a guide portion of the anchoring member. The diagonal member is then placed so that one end contacts the wall and the other end is supported by the surface adjacent to the wall. Each end of the cable is then attached to end portions of the diagonal member and tension applied to the cable by means of a turnbuckle or winch so that compressive forces are simultaneously exerted against the wall and the adjacent surface. The diagonal member includes a strut member which may be of varying length having telescoping portions or it may be one piece and separable from socket members adapted to receive end portions of the strut and to which the ends of the cable are attached.

11 Claims, 19 Drawing Figures

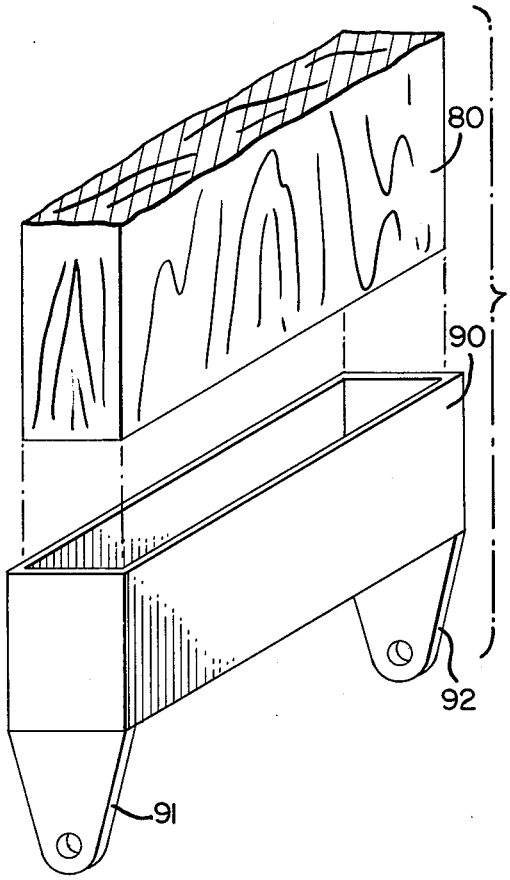
FIG. 16.
FIG. 17.
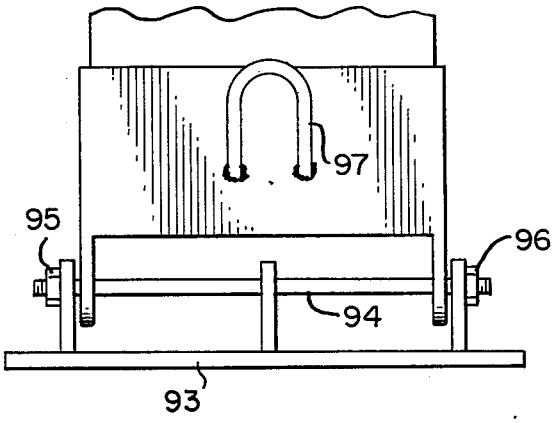
FIG. 18.
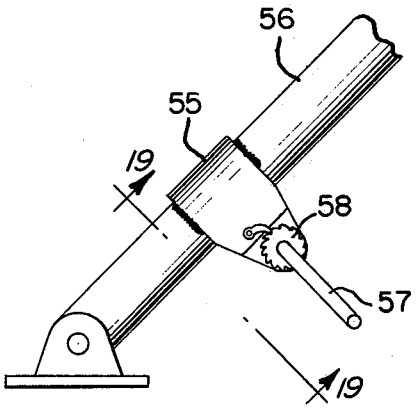
FIG. 19.
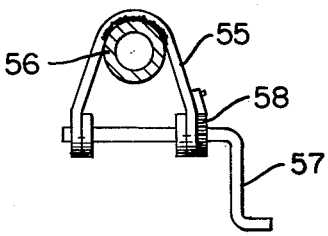

BRACING APPARATUS

BACKGROUND OF THE INVENTION

This invention relates to a support system for use in the construction industry and more particularly to a bracing apparatus which is especially useful for prefabricated or on-site wall construction. The construction industry has long been faced with the problems of supporting a wall vertically so that it will resist windloads prior to its connection with other structural elements. One of the more common methods of providing such bracing involves wooden members which are secured at an angle against the wall, usually by proping one end against the wall to be braced and securing the other end with a peg. This method has proved to be unsatisfactory for many reasons including the wasteful and expensive use of the lumber, and the impracticality of such a system under certain environmental conditions, such as where the ground is either too soft or too hard, or the floor slab had already been poured so that there is no way to anchor the wood member. Various means have been proposed as alternatives to such a wooden brace including, for example, those suggested in U.S. Pat. Nos. 2,511,584 and 3,817,006 as well as in Italian Pat. No. 529,964. Each of these references shows, in one form or another, a vertical support member which is placed against the side of the wall to be braced, a non-flexible horizontal strut member connected to the bottom end of the vertical support member, and at least one adjustable diagonal member which connects the horizontal and vertical members to form a triangular base.

While such devices have been used as alternatives to the wood brace they are relatively heavy and expensive as well as somewhat inflexible in their application because of the limitations inherent in the rigid nature of the members comprising the brace.

SUMMARY OF THE INVENTION

A bracing apparatus has now been developed according to this invention which does not include rigid vertical and horizontal support members but instead utilizes a flexible stay member, preferably a wire cable, which forms the horizontal and vertical elements of a triangular brace, the third member being a diagonal member which extends from the wall to be braced to a substantially horizontal surface adjacent to the wall. The stay member, e.g., cable, is attached at one end to an upper portion of the diagonal member which is to contact the wall, guided through an anchor means secured near the bottom of the wall and connected at the other end of the cable to a bottom portion of the diagonal member which engages the surface adjacent to the wall. Means are provided for tightening the stay member to simultaneously force the upper distal portion of the diagonal member against the wall and the bottom distal portion thereof against the adjacent surface. The tightening means may include a turnbuckle or a winch, and locking means are provided to insure that appropriate tension will be maintained on the stay member until it is no longer necessary. The diagonal member includes a strut member which may be one-piece or adjustable. The distal end portions of the strut member may be integral with or separable from socket members pivotally mounted on bracketed plate members. The plate members, respectively contact and exert compressive forces on the horizontal surface and the vertical wall when tension is applied to the connected stay member. The plate member contacting the structure may do so directly, or indirectly when in the form of a channel member which receives a wooden bracing element. The strut member may be formed from wood, pipe, channel irons or any suitable solid element which will withstand the tension loads necessarily exerted thereon.

Accordingly, it is a principal object of this invention to provide an economical bracing apparatus for vertical structures which may be conveniently transported to a construction site and efficiently erected but easily dismantled for subsequent applications.

It is another object of this invention to provide a wall supporting brace which will resist windloads impinging on the wall from either side.

The attainment of these and other objects will become apparent in the ensuring description of the present invention.

BRIEF DESCRIPTION OF THE DRAWINGS

FIG. 16 is an exploded view of the lower distal portion of the diagonal member shown in FIG. 13.

FIG. 17 is a fragmentary elevational view of the lower distal portion of the diagonal brace and its mounting on a foot plate.

FIG. 18 is a fragmentary elevational side view of a winch connection for the cable member of the invention.

FIG. 19 is a sectional view taken on line 19—19 of FIG. 18.

DESCRIPTION OF THE PREFERRED EMBODIMENTS

Figure 1:
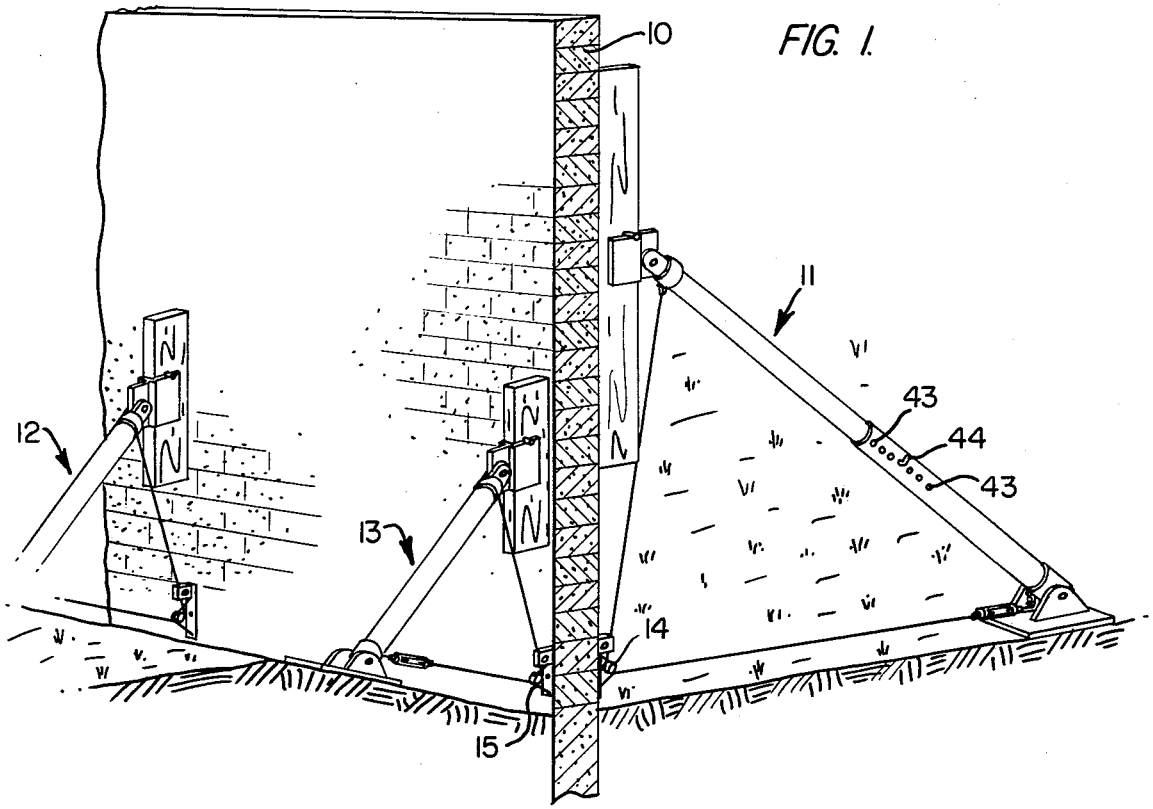
FIG. 1 is a perspective view of a wall section supported by opposed pairs of bracing devices in accordance with the invention.

Referring to the drawings in detail, FIG. 1 shows a plurality of bracing devices according to this invention, placed on opposite sides of a typical outer building wall, in a spaced but cooperating relationship, so as to provide temporary support for the wall and resist windloads impinging upon it from either side prior to connection with other components of the building structure. Bracing devices 12 and 13 are shown supporting the visible side of wall 10 but only one bracing device 11 of the matching pair on the opposite side of the wall is in view. Since the bracing devices illustrated in FIG. 1 are substantially identical, all will be described with reference to bracing device 11.

Figure 2:
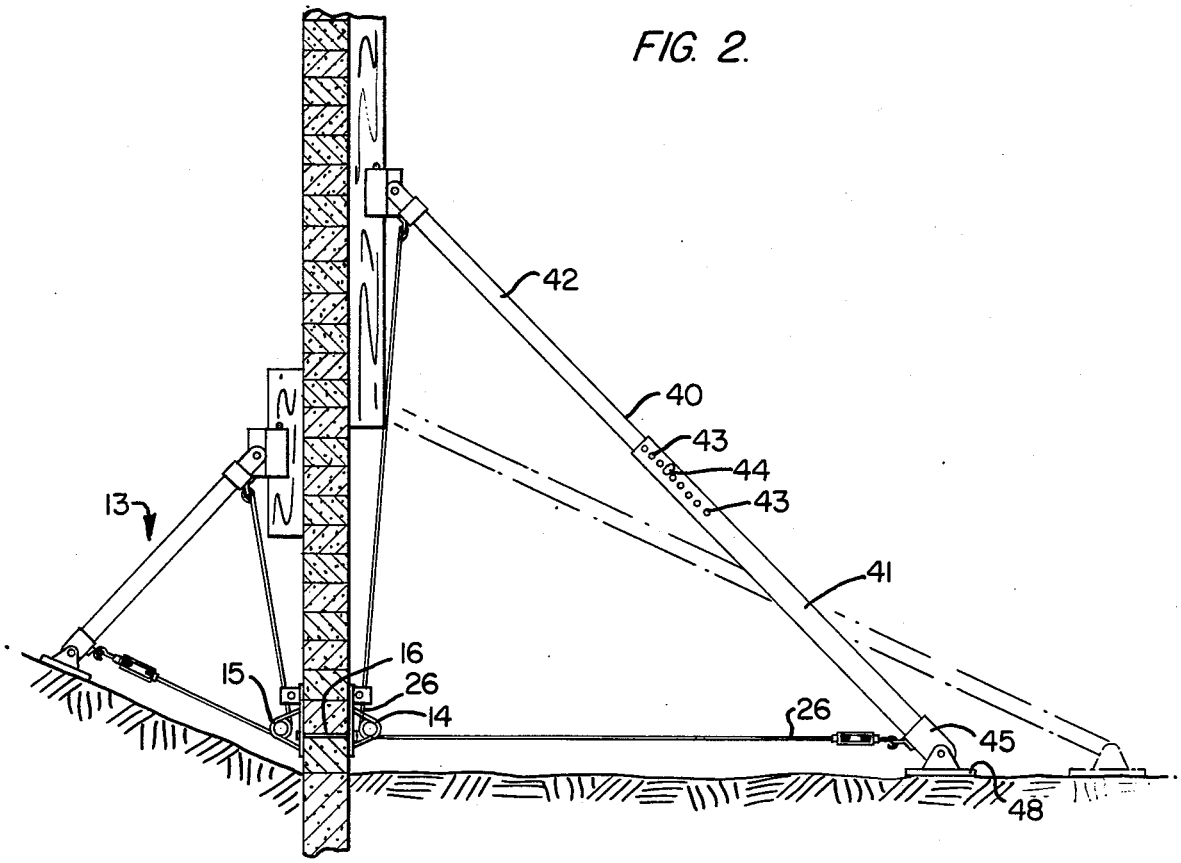
FIG. 2 is a fragmentary and elevational view of the bracing devices in position as shown in FIG. 1.
Figure 6:
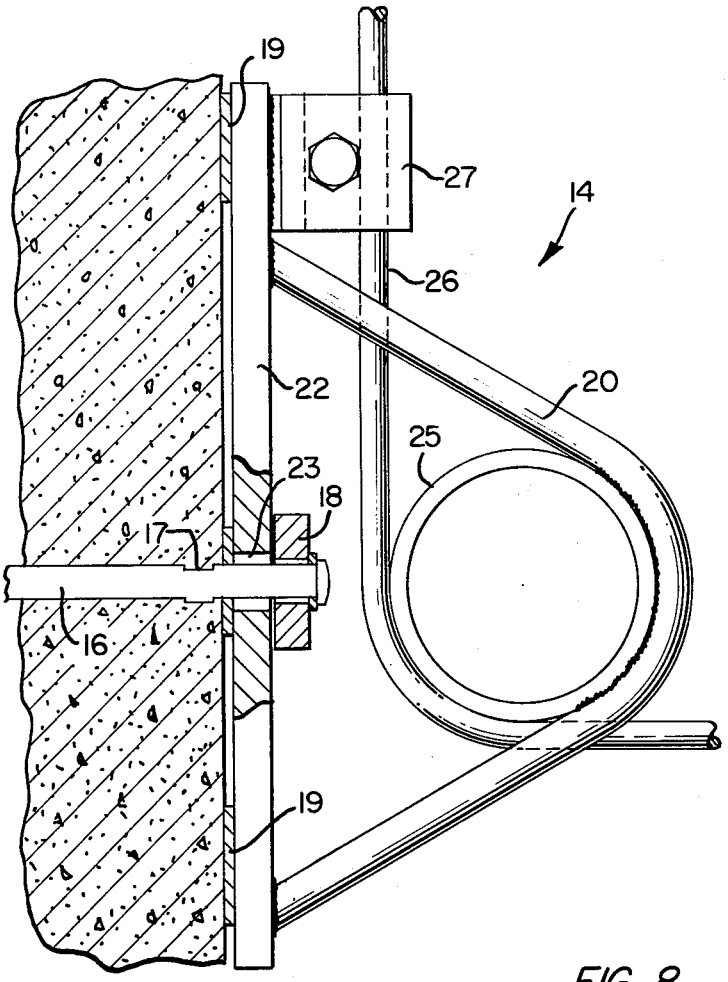
FIG. 6 is a fragmentary, partially sectioned view of a guide member of the invention secured to a bottom portion of the wall as shown in FIG. 2.
Figure 7:
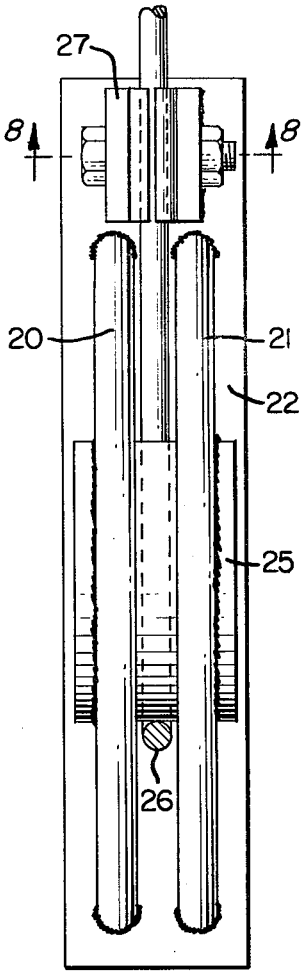
FIG. 7 is a front elevational view of the guide member shown in FIG. 6.
Figure 8:
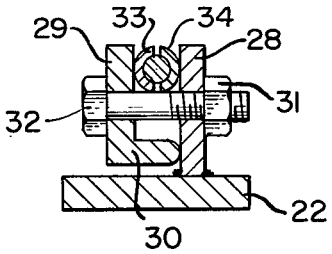
FIG. 8 is a sectional view taken on line 8—8 of FIG. 7.

A pair of guide members 14, 15 are anchored on opposite sides of the wall 10 near its base by anchoring means in the form of a snap-tie member 16, or a nut and bolt arrangement, in a manner more clearly seen in FIG. 2. The tie member is usually embedded in a mortar joint as the wall is constructed, but in the case of a prefabricated wall holes may be drilled at selected intervals to accommodate the ties. Where a nut and bolt arrangement is anticipated, a sleeve member having an inner diameter slightly larger than the diameter of the bolt may be embedded at appropriate intervals in the wall to receive the bolt and facilitate its removal when the brace is no longer required. The tie member includes notches 17 (FIG. 6) near each end which permits the tie to be broken off inside the wall by twisting the exposed end portions thereof after it has served its purpose. After such ends are broken off, the resulting holes in the wall may be easily pointed up or covered with mortar. Each guide member, as illustrated in FIGS. 6 and 7 includes a pair of bow-shaped rods 20, 21 the ends of which are welded to plate member 22. A center hole 23 is provided in the plate member to accept a distal end portion of tie member 16 which is adapted to receive wedge member 18 for tensioning the tie and securing opposed pairs of plates 22 against the wall. Additional tensioning is provided by shims 19. Shims will not be necessary where a nut and bolt tie is used. A tube member 25 is welded on the inner bowed portions of rods 20, 21 and serves as a guide for flexible stay or cable member 26, the ends of which are connected to other portions of the bracing device in a manner to be described below. A clamp member 27 is provided to grip and maintain tension on the cable after the bracing device is set in place and includes a flat bar 28 (FIG. 8), welded at one end to an upper portion of the plate 22, and an angle bar 29, a shorter, perpendicular portion 30 of which is supported in a contacting relationship with the flat bar 28 by a nut 31 and bolt 32 arrangement extending through a hole in each bar. Split pipe elements 33, 34, which together have the same inner diameter as the diameter of the cable, are welded respectively to facing portions of the angle bar and flat bar so that when the nut 31 is tightened, the split elements 33, 34 will be forced together so as to squeeze the cable and lock it in place.

Figure 9:
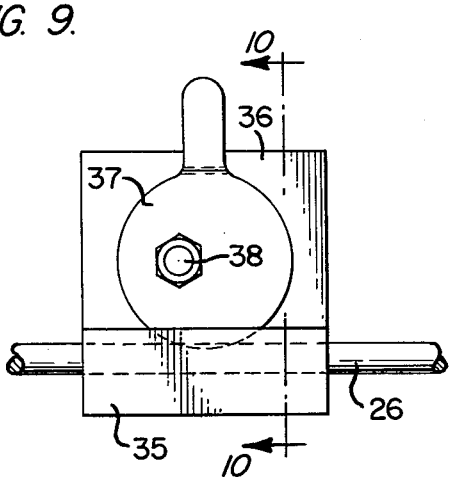
FIG. 9 is a side view of a camming device which is used as an alternative to the clamp shown in FIG. 8.
Figure 10:
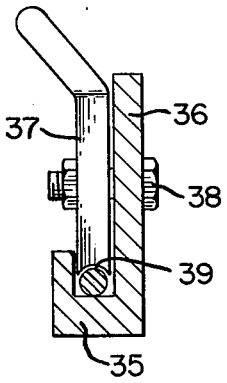
FIG. 10 is a sectional view taken on line 10—10 of FIG. 9.

FIGS. 9 and 10 show a dog or grappler which is used to grip the cable as tension is applied thereto by turning the turnbuckle. It is usually positioned on the cable 26 near the turnbuckle. In this case an L-shaped plate is provided including a lower channel portion 35 through which cable member 26 may be allowed to pass and an upper side portion 36. An offset cam member 37 is apertured and pivotally mounted on the upper portion 36 of the L-shaped plate by a nut and bolt arrangement 38. The cam member includes a handle portion and a grooved portion 39 which will squeeze and grip the cable member 26 when the handle is turned to the lock position.

Figure 5:
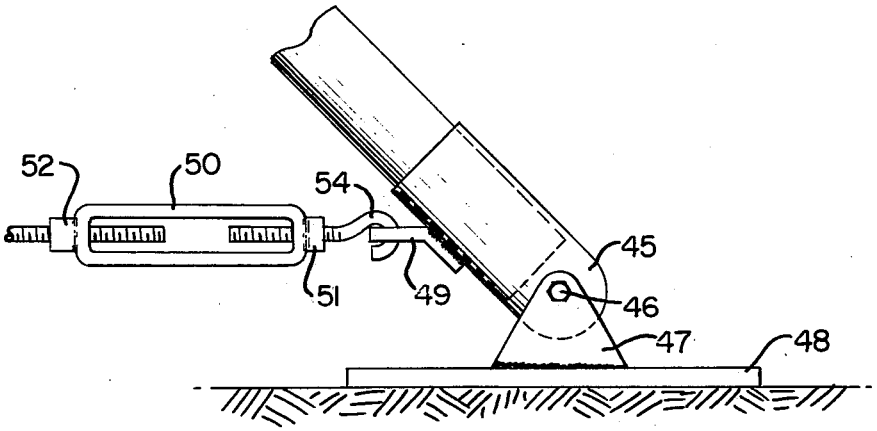
FIG. 5 is a fragmentary view of the lower distal portion of the diagonal member of the invention showing a cable connected thereto through a turnbuckle.

As illustrated in FIG. 2 once the guide members are secured to the wall and the cable member 26 is threaded around the tube member 25, the ends of the cable are attached respectively to distal end portions of a diagonal strut member 40 which, together with support members associated with the end portions of the strut member, forms the third element of the triangular structure, the the cable constituting the horizontal and vertical elements of the brace. The diagonal member 40 is telescoping and therefore of adjustable length so that the brace can be moved, for example, between the solid and broken line positions shown in the drawing. Of course, the strut portion of the diagonal member may also be one piece and formed from an angle iron, a channel iron or any type of strut element, but for purposes of this embodiment the strut portion of member 40 will be described as an adjustable pipe member which includes a lower pipe section 41 and a telescoped upper pipe section 42. A series of holes 43 are adapted to receive a pin 44 which form adjustable means to secure the length of the strut in any one preselected position to determine the length of the strut. As seen in FIG. 5 the lower pipe section 41 fits into a support member in the form of an apertured socket element 45 pivotally mounted by pin 46 in bracket 47 which is welded to horizontal plate 48. The plate 48 acts as a foot for the brace and is able to assume a position flat with the underlying surface. The portion of the pipe section received in socket 45 is removable, although it may also be welded therein to form an integral unit. However, the separable construction is preferred since the bracing device may be taken apart in order to facilitate its transportation. The socket portion 45 includes a connection means or loop 49 welded to its inner surface so as to connect with one end of the cable.

The end portion of the cable 26 connected to the socket member 45 is provided with a tensioning member in the form of a turnbuckle 50 having right-hand 51 and left-hand 52 threaded couplings. The cable is attached thereto by any suitable means, such as, for example, by using a mutilated bolt, a split end of which secures the cable while the threaded end mates with the left-hand screw coupling. The right-hand coupling 52 mates with a hook bolt 54 which is secured to loop 49. When both ends of the cable are attached to the diagonal member the turnbuckle is employed to apply tension to the cable whereupon compressive forces are exerted by the diagonal member against the wall and the adjacent surface.

An alternate tensioning means is shown in FIGS. 18 and 19 in the form of a winch comprising a bracket 55 welded to strut 56, the flanges of the bracket being apertured to receive an axle, including a handle portion 57, upon which is mounted a ratchet and pawl arrangement 58. The cable is attached to the axle by any suitable means and tightened by turning the handle.

Figure 3:
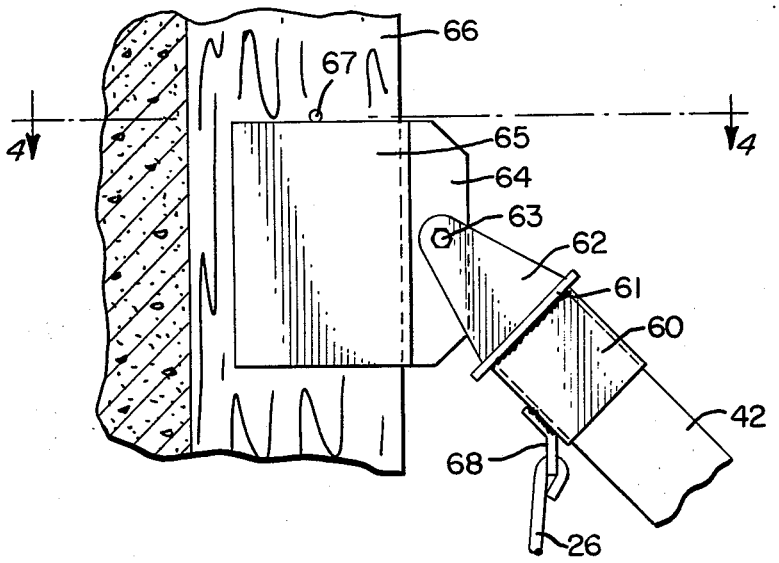
FIG. 3 is a fragmentary, partially sectioned view of an upper distal portion of the diagonal member of the invention.
Figure 4:
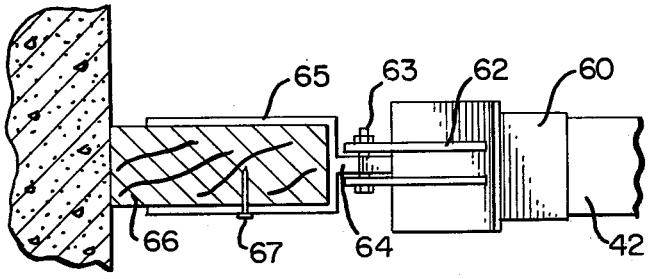
FIG. 4 is a sectional view taken on line 4—4 of FIG. 3.

The upper pipe section 42 is illustrated in the embodiment of FIGS. 3 and 4 as being fitted into a supporting member in the form of a socket member 60 welded to bracket 61, the flange portions 62 of which are apertured and pivotally mounted by pin 63 onto a flange portion 64 of channel member 65. A rigid beam member or plank 66 is fitted into the channel portion of the channel member 65 and is secured in that position by a nail 67. The plank 66 contacts the wall over an extended surface of the wall and exerts compressive force thereon when the cable 26 attached to connection means or loop 68 is tightened.

Figure 11:
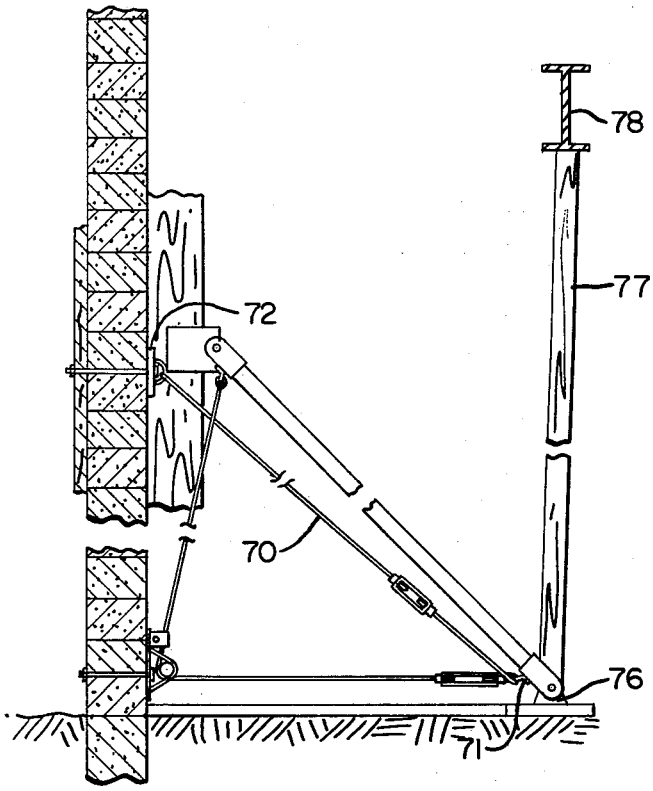
FIG. 11 is a fragmentary end elevational view of a modification of the invention.
Figure 12:
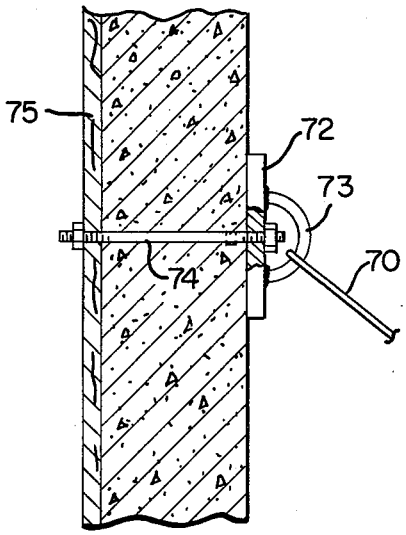
FIG. 12 is a fragmentary, partially sectioned view of a loop coupling shown in FIG. 11.

FIGS. 11 and 12 illustrate an embodiment of the invention which may be utilized when other components of the building construction have already been erected and it is undesirable to use braces on both sides of the wall. The brace of this embodiment is essentially the same as that illustrated in FIG. 2 except that it includes a second stay member 70, in this case a cable, including a turnbuckle, which is attached at one end to a connection means or loop 71 and at the other end to a plate member 72 including a a connection means or loop 73, the plate member being secured to the wall by an anchoring means or snap-tie 74, securing a plank 75 to the other side of the wall. The support means or bracket plate member 76 is secured against movement by wedging a timber 77 at one end against its surface and at the other end against an existing component 78 of the building construction.

Figure 13:
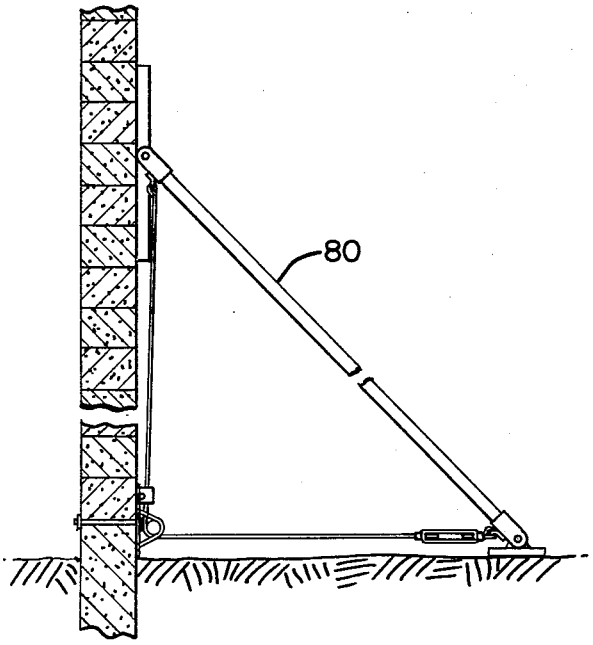
FIG. 13 is a fragmentary end elevational view of a further modification of the invention.
Figure 14:
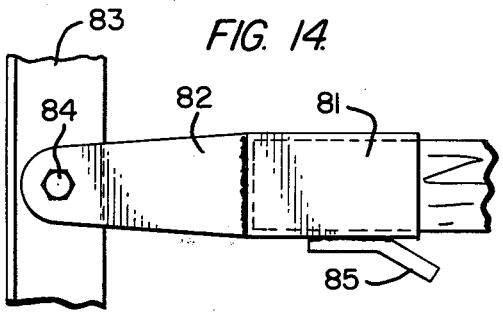
FIG. 14 is a fragmentary side view of an upper distal portion of the diagonal member shown in FIG. 13.
Figure 15:
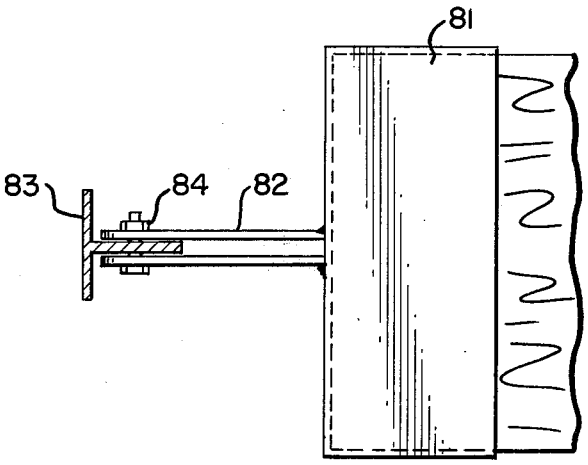
FIG. 15 is a top plan view, partially in section, of the upper distal portion shown in FIG. 14.

FIG. 13 shows a further embodiment of the invention similar to that presented in FIG. 2 except in this instance the diagonal strut member 80 is a wooden plank which, as seen in FIGS. 14 and 15, is fitted at an upper end into support means in the form of a socket member 81 including an apertured bracketed portion 82 which is pivotally mounted on the foot section of a T-bar 83 by a nut and bolt arrangement 84. A connection means or loop 85 is welded onto the bottom surface of the socket member and, as in the case of FIG. 2, serves as a connection for one end of the cable.

FIGS. 16 and 17 show the bottom support means or socket member for the brace illustrated in FIG. 13. The socket member 90 includes spaced bracket portions 91, 92 which are apertured so that the socket member may be pivotally mounted on foot plate member 93 by spindle 94 which is secured in position by nuts 95, 96. A connection means or loop 97 is welded to the inside surface of the socket member to receive a hook bolt as illustrated in FIG. 5.

While the above description of the invention has been principally directed to a wall structure it should be apparent that the apparatus defined in the ensuing claims will be suitable for supporting any free-standing non-flexible structure.

The above embodiments are to be considered in all respects as illustrative and not restrictive since the invention may be embodied in other specific forms without departing from its spirit or essential characteristics. Therefore, the scope of the invention is indicated by the claims rather than by the foregoing description, and all changes which come within the meaning and range of the equivalents of the claims are intended to be embraced therein.

I claim:

1. Apparatus for temporarily bracing against windloads an upright structure resting on a foundation comprising a rigid diagonal member, first support means associated with one end portion of the diagonal member for supporting engagement with a side surface of the upright structure, second support means associated with the other end portion of the rigid diagonal member for supporting engagement with a support surface adjacent the side of the upright member, anchoring means secured to the structure at a point above the foundation, guide means associated with the anchoring means for engaging and guiding a flexible stay member under tension, an elongated, continuous flexible stay member passing longitudinally around and in guided relation to the guide means, first connection means connecting one end of the flexible stay member to the one end portion of the rigid diagonal member, second connection means connecting the other end of the flexible stay member to the other end portion of the rigid diagonal member, tensioning means acting on the flexible stay member between the first and second connection means for drawing the flexible stay member tight around the anchor guide means between the first connection means and the second connection means to thereby exert controlled forces on each of the end portions of the diagonal member acting in the direction of the guide means, whereby the rigid diagonal member exerts compressive forces on the upright structure and the support surface.

2. The apparatus of claim 1 wherein the first support means comprise bracket means pivotally mounted on the associated end portion of the diagonal member, and means are associated with the bracket means for holding a rigid beam member in supporting relation to an extended surface area of the associated side of the upright structure.

3. The apparatus of claim 2 wherein the second support means comprises a pivotally mounted bracket means, and a plate member is carried by the bracket for engagement with an extended surface area of the support surface adjacent the side of the upright member.

4. The apparatus of claim 3 wherein the rigid diagonal member comprises telescoping portions, and adjustable means secure the telescoping portions relative to one another to determine the length of the diagonal member.

5. The apparatus of claim 4 wherein means for gripping the flexible stay member and maintaining tension thereon are associated with the guide means.

6. The apparatus as claimed in claim 5 wherein a second anchoring means is secured to the structure at a point above the foundation in the neighborhood of the first support means, a second flexible stay member has one end connected to the second support means and the other end connected to the second anchoring means, and there are tensioning means acting on the second flexible stay member between the second anchoring means and the second connection means for drawing the second flexible stay member tight.

7. The apparatus of claim 1 wherein the rigid diagonal member comprises telescoping portions, and adjustable means secure the telescoping portions relative to one another to determine the length of the diagonal member.

8. The apparatus of claim 7 wherein means for gripping the flexible stay member and maintaining tension thereon are associated with the guide means.

9. The apparatus of claim 1 wherein means for gripping the flexible stay member and maintaining tension thereon are associated with the guide means.

10. The apparatus of claim 9 wherein a second anchoring means is secured to the structure at a point above the foundation in the neighborhood of the first support means, a second flexible stay member has one end connected to the second support means and the other end connected to the second anchoring means, and there are tensioning means acting on the second flexible stay member between the second anchoring means and the second connection means for drawing the second flexible stay member tight.

11. The apparatus of claim 1 wherein a second anchoring means is secured to the structure at a point above the foundation in the neighborhood of the first support means, a second flexible stay member has one end connected to the second support means and the other end connected to the second anchoring means, and there are tensioning means acting on the second flexible stay member between the second anchoring means and the second connection means for drawing the second flexible stay member tight.

* * * * *